US009320958B2

(12) United States Patent
Yoo

(10) Patent No.: US 9,320,958 B2
(45) Date of Patent: Apr. 26, 2016

(54) GOLF PUTTING PRACTICE MACHINE HAVING LASER POINTER

(71) Applicant: DuckSang Yoo, Seoul (KR)

(72) Inventor: DuckSang Yoo, Seoul (KR)

( * ) Notice: Subject to any disclaimer, the term of this patent is extended or adjusted under 35 U.S.C. 154(b) by 0 days.

(21) Appl. No.: 14/418,421

(22) PCT Filed: Aug. 1, 2013

(86) PCT No.: PCT/KR2013/006924
§ 371 (c)(1),
(2) Date: Jan. 29, 2015

(87) PCT Pub. No.: WO2014/021648
PCT Pub. Date: Feb. 6, 2014

(65) Prior Publication Data

US 2015/0182838 A1 Jul. 2, 2015

(30) Foreign Application Priority Data

Aug. 2, 2012 (KR) ..... 10-2012-0084789

(51) Int. Cl.
*A63B 57/00* (2015.01)
*A63B 69/36* (2006.01)
(Continued)

(52) U.S. Cl.
CPC ..... *A63B 69/3676* (2013.01); *A63B 47/008* (2013.01); *A63B 57/00* (2013.01);
(Continued)

(58) Field of Classification Search
CPC ..... A63B 57/00; A63B 69/3676; A63B 69/3658; A63B 47/008; A63B 2225/09; A63B 2220/30
See application file for complete search history.

(56) References Cited

U.S. PATENT DOCUMENTS 3,215,436 A * 11/1965 Carter ..... A63B 69/3661 264/54
4,997,189 A 3/1991 Perkins
(Continued)

FOREIGN PATENT DOCUMENTS

JP 2002-306657 A 10/2002
KR 20-0370877 Y1 12/2004
(Continued)

OTHER PUBLICATIONS

PCT International Search Report for PCT Counterpart Application No. PCT/KR2013/006924, 5 pages (including English translation), (Dec. 2, 2013).
(Continued)

*Primary Examiner* — Steven Wong
(74) *Attorney, Agent, or Firm* — Blakely, Sokoloff, Taylor & Zafman LLP

(57) ABSTRACT

Provided is a golf putting practice machine having a laser pointer, the golf putting practice machine includes: a laser direction adjustment plate (1) that that determines whether or not an emitted laser beam is directed in a normal direction; a laser pointer (2) that emits the laser beam toward the laser direction adjustment plate (1) when an ON/OFF switch (2-1) is in the ON state, wherein said switch is arranged to enable or prevent the emission of the laser beam; a laser pointer accommodating portion (3) that accommodates and fixes the laser pointer (2); a laser mount (4) on which the laser pointer accommodating portion (3) is mounted in an adhering manner; an aiming upper plate (5) on which the laser direction adjustment plate (1) and the laser mount (4) are placed so as to be slidable; an aiming plate (6) on which the aiming upper plate (5) is placed such that the ongoing direction of a golf ball is accurately set; a force-conversion roller (7) that converts the freefall of a golf ball into a horizontal force; a horizontal adjustment support plate (8) that fixes and supports the force-conversion roller (7) and performs leveling; an inclined height plate (9) that is connected to the force-conversion roller (7) so as to cause the golf ball to freefall; and a ball height adjustment plate (10) that is slidably connected to the inclined height plate (9) so as to determine the height from which the golf ball freefalls.

28 Claims, 7 Drawing Sheets

(51) Int. Cl.
*A63B 47/00* (2006.01)
*A63B 71/06* (2006.01)

(52) U.S. Cl.
CPC ..... *A63B69/3658* (2013.01); *A63B 2071/0694* (2013.01); *A63B 2207/02* (2013.01); *A63B 2210/50* (2013.01); *A63B 2220/70* (2013.01); *A63B 2225/02* (2013.01); *A63B 2225/09* (2013.01); *A63B 2225/093* (2013.01); *A63B 2243/002* (2013.01); *A63B 2243/0058* (2013.01); *A63B 2243/0062* (2013.01)

(56) References Cited

U.S. PATENT DOCUMENTS 5,358,447 A * 10/1994 Erickson ..... A63D 5/00 473/56
6,042,482 A * 3/2000 Wilds ..... A63D 5/00 273/120 R
6,227,981 B1 * 5/2001 Lizama Troncoso ..... A63B 71/0009 473/54
6,547,680 B1 * 4/2003 Marchese, Jr. ..... A63B 53/007 473/404
7,306,524 B1 * 12/2007 Rogers ..... A63B 24/0021 473/167
2003/0226393 A1 * 12/2003 Pelz ..... A63B 57/00 73/9
2004/0058754 A1 * 3/2004 Hughes ..... A63B 69/3614 473/404
2004/0097303 A1 * 5/2004 Hughes ..... A63B 57/00 473/404
2009/0100928 A1 * 4/2009 Fry ..... G01N 19/02 73/491
2010/0331119 A1 * 12/2010 de la Gandara .... A63B 69/3676 473/404
2013/0079171 A1 3/2013 Bittner
2015/0204777 A1 * 7/2015 Quintavalla ..... G01N 19/02 73/9

FOREIGN PATENT DOCUMENTS

KR 10-2007-0090526 A 9/2007
KR 10-2009-0020747 A 2/2009
KR 10-1146396 B1 5/2012

OTHER PUBLICATIONS

Office Action received from the Korean Intellectual Property Office for counterpart Korean Patent Application No. 10-2012-0084789, 2 pages (only English Translation), (Nov. 9, 2012).
Notice of Allowance received from the Korean Intellectual Property Office for counterpart Korean Patent Application No. 10-2012-0084789, 1 page (only English Translation), (Jun. 27, 2013).
PCT Written Opinion of the International Searching Authority for PCT Counterpart Application No. PCT/KR2013/006924, 4 pages, (Dec. 2, 2013).

* cited by examiner

GOLF PUTTING PRACTICE MACHINE HAVING LASER POINTER

CROSS-REFERENCE TO RELATED APPLICATIONS

This patent application is a U.S. National Phase Application under 35 U.S.C. §371 of International Application No. PCT/KR2013/006924, filed on Aug. 1, 2013, entitled GOLF PUTTING PRACTICE MACHINE INCLUDING LASER POINTER, which claims priority from Korean Patent Application No. 10-2012-0084789, filed on Aug. 2, 2012, in the Korean Intellectual Property Office, the disclosure of which was incorporated by reference in its entirety.

BACKGROUND OF THE INVENTION

1. Field of the Invention

The present disclosure relates to a golf putting practice machine (or a golf putting exerciser), and more particularly, a golf putting practice machine having a laser pointer, which enables a precise putting practice for golf by measuring an ongoing (progressing, rolling or moving) speed and an ongoing direction of a golf ball, which are required upon practicing putting, using an aiming plate, a force-conversion roller, an inclined height plate and a laser pointer which emits laser beams.

2. Description of the Related Art

Golf putting may be roughly classified into two parts.

A first part relates to the calculation of accurate direction and speed. A putting lie is correctly read and ongoing direction and speed of a golf ball is decided. That is, it is calculated in which direction and how fast the golf ball should be putted (hit). This calculation should be performed by a golfer himself/herself but can be done and informed by a competent caddy.

A second part relates to a precise behavior for the calculated direction and speed. It means capability of hitting a golf ball in an accurate direction and at an accurate speed. Such capability requires for more practice and efforts of a golfer.

The ability for accurately performing the two parts of the putting is the first and the last of the golf putting. However, there has absolutely not been any golf putting practice machine introduced to fully help golfers perfectly perform such two functions.

Taking this into account, the applicant has filed on Jan. 7, 2010 a golf putting practice machine, which enables an accurate calculation of speed and direction that a golf ball advances (rolls, moves) during a golf putting practice so as to help the golf putting practice, and granted U.S. Pat. No. 1,146,396 (Name of the invention: Golf Putting Practice Machine) on May 8, 2012.

However, in U.S. Pat. No. 1,146,396, the machine has several disadvantages of a shortage of stability, a difficulty in leveling, a limited height in view of a laser beam emitting range, causing much friction on connection members during the freefall of a golf ball, causing a height difference from the ground when the golf ball is slid out of an aiming plate, and a burden of using a means for adjusting a height from which the golf ball is to freefall.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention has been invented by taking into account the points and fully overcome those disadvantages, caused in U.S. Pat. No. 1,146,396, filed and granted patent by this applicant. Thus, an aspect of the present invention is to provide a golf putting practice machine having a laser pointer, which enables an effective putting practice by recognizing and calculating ongoing direction and speed of a golf ball in a correct and precise manner during the golf putting practice.

A golf putting practice machine having a laser pointer according to the present invention to achieve the aspect may include a laser direction adjustment plate 1 that is configured to determine whether or not an emitted laser beam is directed in a normal direction, a laser pointer 2 that is configured to emit the laser beam toward the laser direction adjustment plate 1 when an ON/OFF switch 2-1 is in the ON state, wherein the switch is arranged to enable or prevent the emission of the laser beam, a laser pointer accommodating portion 3 that is configured to accommodate and fix the laser pointer 2 therein, a laser mount 4 on which the laser pointer accommodating portion 3 is mounted in an adhering manner, an aiming upper plate 5 on which the laser direction adjustment plate 1 and the laser mount 4 are placed so as to be slidable, an aiming plate 6 on which the aiming upper plate 5 is placed such that the ongoing direction of a golf ball is accurately set, a force-conversion roller 7 that is configured to convert the freefall of a golf ball into a horizontal force, a horizontal adjustment support plate 8 that is configured to fix and support the force-conversion roller 7 and perform leveling, an inclined height plate 9 that is connected to the force-conversion roller 7 so as to cause the golf ball to freefall, and a ball height adjustment plate 10 that is slidably connected to the inclined height plate 9 so as to determine the height from which the golf ball freefalls.

The practice machine may further include a horizontal maintenance plate 11 that is provided below the horizontal adjustment support plate 8 such that the horizontal adjustment support plate 8 is kept horizontal to the ground.

The laser direction adjustment plate 1 may be placed on the aiming upper plate 5 to be slidable on the aiming upper plate 5 in a manner that inner sides of left and right side surfaces 1-1 and 1-2 thereof are engaged with outer sides of left and right side surfaces 5-2 and 5-3 of the aiming upper plate 5, respectively, and an upper plate 1-3 thereof is brought into contact with a top of the aiming upper plate 5.

The laser direction adjustment plate 1 may be provided with a laser beam aiming plate 1-4 that perpendicularly extends upward from one end portion of the upper plate 1-3 thereof, the one end portion facing the laser pointer 2, and a laser beam aligning line L that is formed from up to down along a central portion of the laser beam aiming plate 1-4 and has a central point 1-5.

The laser pointer accommodating portion 3 may include first and second direction adjustment screws 3-1 and 3-2 that are provided on one side surface thereof to adjust a laser beam emitted from the laser pointer 2 to a left or right side, and a hole 3-3 through which the laser beam emitted from the laser pointer 2 passes. The first and second direction adjustment screws 3-1 and 3-2 may be disposed on the one side surface of the laser pointer accommodating portion 3 to reach corresponding one side portions of the laser pointer 2, respectively.

The laser beam emitted from the laser pointer 2 may be emitted toward the laser beam aiming plate 1-4 of the laser direction adjustment plate 1 through the hole 3-3 formed through the laser pointer accommodating portion 3.

The laser mount 4 may be placed on the aiming upper plate 5 to be slidable back and forth on the aiming upper plate 5 in a manner that inner sides of left and right side surfaces 4-1 and 4-2 thereof are engaged with outer sides of left and right side surfaces 5-2 and 5-3 of the aiming upper plate 5, respectively, and an upper plate 4-3 thereof is brought into contact with the top of the aiming upper plate 5.

The upper plate 4-3 of the laser mount 4 may be provided with a height adjustment screw 4-4 that is located at a central portion thereof, which is spaced apart from an end portion of the upper plate 4-3, which faces the laser direction adjustment plate 1, by a predetermined distance toward the laser pointer accommodating portion 3, so as to adjust the height of the laser mount 4 in up and down directions.

The aiming upper plate 5 may be engaged with the aiming plate 6 to be slidable on the aiming plate 6. The aiming upper plate 5 may include an upper surface 5-1, and the left and right side surfaces 5-2 and 5-3 that perpendicularly extend downward from both end portions of the upper surface 5-1. Cutoff portions 5-4 and 5-5 may be formed by partially cutting off lower end portions of the left and right side surfaces 5-2 and 5-3 in a lengthwise direction, respectively. The aiming upper plate 5 may be slidable on the aiming plate 6 in a manner that the cutoff portions 5-4 and 5-5 are engaged with both outer sides of the top of the aiming plate 6.

The aiming plate 6 may be coupled to a front end of the force-conversion roller 7. The aiming plate 6 may include a pair of insertion holes 6-1 and 6-2 that is formed at one end along which the golf ball rolls out, and in which a pair of insertion members 12-1 and 12-2 formed in a cylindrical shape is inserted. The aiming plate 6 may also include a pair of insertion holes that is formed at the other end thereof coupled with the force-conversion roller 7 and in which the pair of insertion members 12-1 and 12-2 is inserted.

The aiming plate 6 and the force-conversion roller 7 may be coupled to each other in a manner that the insertion members 12-1 and 12-2 are inserted into the pair of insertion holes, which is formed at the other end of the aiming plate 6, and the inserted insertion members 12-1 and 12-2 are inserted into a pair of insertion holes 7-1 and 7-2 formed at the force-conversion roller 7.

Two of the aiming plates may be connected for use in a manner that the pair of insertion members 12-1 and 12-2 is inserted into the pair of insertion holes 6-1 and 6-2 of the aiming plate 6, which is formed at the one end along which the golf ball rolls out, and the inserted pair of insertion members 12-1 and 12-2 is then inserted into insertion holes of another aiming plate, which is the same as the aiming plate 6.

The golf ball may roll forward in a state where a lower end of the golf ball is spaced apart from a bottom of the aiming plate 6 by a length (c), and outer contact portions of the golf ball may come in contact with outer contact portions of inclined surfaces of an inner surface of the aiming plate 6.

The force-conversion roller 7 may have one end (a), along which the gold ball rolls out and to which the aiming plate 6 is connected, and the other end (b) to which the inclined height plate 9 is connected. The force-conversion roller 7 and the inclined height plate 9 may be connected to each other in a manner that the insertion members 12-1 and 12-2 are inserted into the pair of insertion holes 7-3 and 7-4 formed a the other end (b) coupled with the inclined height plate 9, and the inserted insertion members 12-1 and 12-2 are then inserted into a pair of insertion holes formed at one end of the inclined height plate 9. Totally four fastening screw holes 7-6 may be provided by two at each of both sides of a lower end portion of the force-conversion roller 7, such that the force-conversion roller 7 can be connected to the horizontal adjustment support plate 8.

The force-conversion roller 7 may have an arcuate portion (K) formed in an arcuate shape from a first part (x) to a second part (y). The arcuate portion (K) may be formed in the arcuate shape with a radius of 200 mm. An angle formed between a portion from the first part (x) to the one end (a) and a portion from the second part (y) to the other end (b) may be 60°.

An angle of the arcuate shape of the arcuate portion (K) may range from 1° to 90°.

The arcuate portion (K) may be formed in the arcuate shape with a radius of 50 mm to 1,000 mm.

A length from the first part (x) to the one end (a) of the force-conversion roller 7 may be 200 mm, and a length from the second part (y) to the other end (b) may be 50 mm.

The length from the first part (x) to the one end (a) of the force-conversion roller 7 may range from 0 mm to 1,000 mm.

The length from the second part (y) to the other end (b) of the force-conversion roller 7 may range from 0 mm to 1,000 mm.

The horizontal adjustment support plate 8 may include an horizontal adjustment screws 8-1 that are provided at four corner portions thereof, a cutoff portion 8-2 formed at one end thereof by being cut off into a shape of "ㄷ", and a pair of connection supporting portions 8-3 and 8-4 that perpendicularly extend upward from both sides of the cutoff portion 8-2. The horizontal adjustment support plate 8 may be set to be horizontal with respect to the ground in a manner of adjusting heights of four portions thereof by adjusting the four horizontal adjustment screws 8-1, respectively. The pair of connection supporting portions 8-3 and 8-4 may be provided with four through holes 8-5 corresponding to the four fastening screw holes 7-6, which are formed at the lower end portion of the force-conversion roller 7. The force-conversion roller 7 and the horizontal adjustment support plate 8 may be coupled to each other in a manner that four fastening screws 7-7 are screwed into the four fastening screw holes 7-6 of the force-conversion roller (7) through the four through holes 8-5 of the horizontal adjustment support plate 8.

Two or three of the inclined height plates 9 may be connected for use.

The ball height adjustment plate 10 may include both side surfaces 10-7 and 10-8 that have cutoff portions 10-4 and 10-5 formed by partially cutting off ends of the both side surfaces 10-7 and 10-8 in a vertical direction, respectively, a trigger mechanism 10-2 that is rotatable centering on a shaft 10-9, a golf ball holder 10-1 that has a top of a front surface with the golf ball placed thereon, and one end attached onto an upper plate of a front surface of the height adjustment plate 10, wherein the other portion of the golf ball holder 10-1 except for the one end may be perpendicularly folded to be brought into contact with an upper portion of the trigger mechanism 10-2, elastic member fixing pins 10-6 that are located on central portions of the both side surfaces 10-7 and 10-8, respectively, and elastic members 10-10 that are fixed at the elastic member fixing pins 10-6, respectively. The cutoff portions 10-4 and 10-5 may be engaged with both sides of the upper end of the inclined height plate 9 such that the ball height adjustment plate 10 can be slidable up and down along the inclined height plate 9. The trigger mechanism 10-2 may be inserted into a trigger mechanism insertion groove 10-3, which is formed at the front surface of the ball height adjustment plate 10, in a manner of rotating centering on the shaft 10-9.

The golf ball holder 10-1 may be made of a material, which is pressed down by a weight of the golf ball immediately when the trigger mechanism 10-2 is drawn out of the trigger mechanism insertion groove 10-3, such that the golf ball can immediately freefall.

The force-conversion roller 7, the aiming plate 6 and the inclined height plate 9 may have a sectional shape of .

An angle θ formed by the both outer contact portions of the inclined surfaces of the inner surface of the shape of may be 90°.

An angle θ formed by the both outer contact portions of the inclined surfaces of the inner surface of the shape of may be in the range of 1° to 179°.

Effect of the Invention

In accordance with the present disclosure, ongoing speed and direction of a golf ball can be precisely recognized during a golf putting practice based on a freefall from an inclined height plate and an arrival position of a laser beam emitted from a laser pointer, resulting in improvement of accuracy of the putting practice.

The machine may be made of acryl, so as to be light in weight, low-priced, facilitated in fabrication, and firm.

An aiming plate, a force-conversion roller and an inclined height plate, along which the golf ball advances (rolls, moves) may be formed in a shape of , so as to allow for smooth rolling of the golf ball. Also, by rarely generating a height difference between the aiming plate and the ground when the golf ball rolls out of the aiming plate, the golf ball can smoothly roll along the ground after rolling out of the aiming plate.

Taking such effects into account, the golf putting practice machine according to the present disclosure can employ a simplified shape and also a simple and easy principle, so as to overcome many unsolved problems occurred during putting. Further, the inventor has confirmed through tests that functions of the golf putting practice machine are performed accurately. Thus, it can be convinced that desired results are surely obtained during the golf putting practice.

Therefore, in addition to the effects, the following remarkable advantages can be realized.

1) Accurate direction and distance can be reproduced.

When a golfer putts a golf ball, it can be reproduced how strong and how far the golf ball has been putted, based on a point where the ball has originally been placed and a point where the ball is rolled and stopped due to being putted.

That is, the golfer can check the reason why the golf ball has missed a hole cup upon the putting.

Also, the accurate direction and distance can be practiced anywhere upon the putting practice.

2) A putting map can be produced.

Golf putting is a game of probability.

It is obvious that long putts are more difficult to short putts, but how difficult the long putts are or how many times more difficult are the long putts that the short putts may not be easy to check. On the other hand, the difference in putts can be calculated using the golf putting practice machine according to the present disclosure.

Also, it can be proved that downhill putts are more difficult than uphill putts.

When the golf ball bounces out a hole cup due to fast speed while it rolls toward the hole cup, meters that the golf ball has rolled away from the hole cup on a corresponding green can be checked, and successive U-turn of the golf ball can be made.

Such matters may be enabled by producing the putting map.

That is, upon rolling balls toward a hole cup at any point in one direction in a manner of gradually increasing speed, the balls do not go into the hole cup when a distance is not enough and then are holed into the hole cup starting from a certain moment. When the rolling speed increases more, then the balls bounce out the hole cup or make U-turns.

If the direction is measured with an interval of 5-mm or 2-mm hole cup, the putting map can be produced.

An area (extent) of the produced map may correspond to probability that the golf ball goes in the hole cup. For example, it can be understood as the same concept as an area of a target in the shooting or archery.

A shape of the map is typically circular, but may employ any of other shapes, instead of the circular shape.

For example, since a putting graph of a tilt next a downhill is thin and long like a woman's eyebrow, a golf ball can be holed in a cup even though being hit in different directions, but an accurate distance should be set. This type of putting may be difficult even with a wide area.

3) A green map can be made.

A practical putting green map can be created even without a design drawing of designing the green.

A great putting green is actually about 900 $m^2$ with about 30 m wide and about 30 m across.

In a state of setting two points A and B on a putting green, if putting a ball from the point A to the point B is measured by the golf putting practice machine according to the present disclosure and the thusly-measured data is collected, the putting direction and speed can be known simply by viewing such data. Of course, to realize this, more efforts for measuring the data plural times should be accompanied.

4) It can be used for training caddies.

Caddies play important roles when reading putting lies.

Caddies who have worked in a specific golf course memorize most of putting greens of the specific golf course. However, competent caddies can carefully inspect even a new golf course where they have not been before, so as to understand greens of the new golf course.

In such a manner, the use of the golf putting practice machine according to the present disclosure may result in distinguishing and even training such caddy of ability.

Furthermore, abilities of caddies can be tested.

5) A stimpmeter can be replaced.

A stimpmeter has been used so far as a device for measuring green speed. The stimpmeter considers a distance, which a ball rolls down when a bar having a slot with about 1-yard depth is inclined by about 20° after placing the ball on the bar, as speed of the corresponding green. The stimpmeter cannot be considered as the same as putting because the ball is hit against a bottom by the inclination of 20°.

The green speed corresponds to speed upon putting and the ball rolls in parallel to the bottom in principle. Therefore, the golf putting practice machine according to the present disclosure can be more appropriate to measure the green speed.

6) It can be used for other ball games.

If the size of the golf putting practice machine according to the present disclosure changes, it can be applied to any type of game rolling a ball.

For example, this machine can be applied to a billiards, a vocce, a gateball, and even a bowling.

7) Golf balls can be distinguished.

The machine can be used for evaluating golf balls.

That is, every ball seems to be visibly the same. However, by tests using the golf putting practice machine according to the present disclosure, the inventor has found that most of golf balls are not actually the same.

That is, it has been checked that golf balls have different rolling patterns depending on brands, and also are different from one another in view of rolling more, rolling less, rolling in different directions, having different centers of gravity and volume.

Therefore, the machine can be used for distinguishing qualities of golf balls, to enable a selection of better balls.

BRIEF DESCRIPTION OF THE DRAWING FIGURES

The above and/or other aspects of the present invention will be more apparent by describing certain exemplary embodiments of the present invention with reference to the accompanying drawings, in which.

Figure 4A:
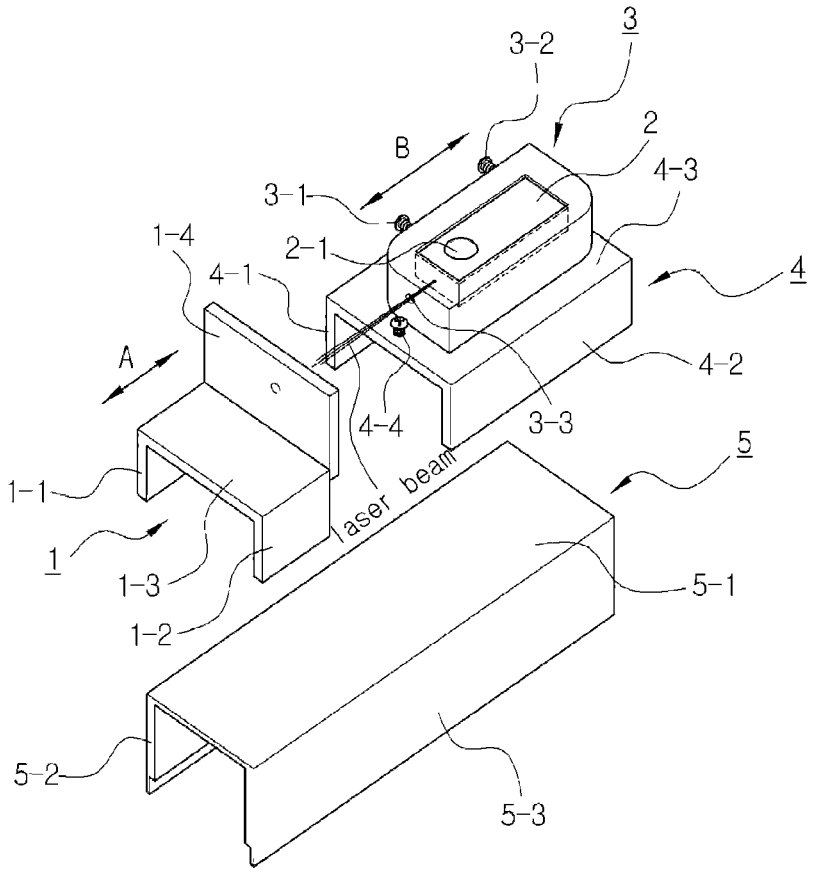
Figure 4B:
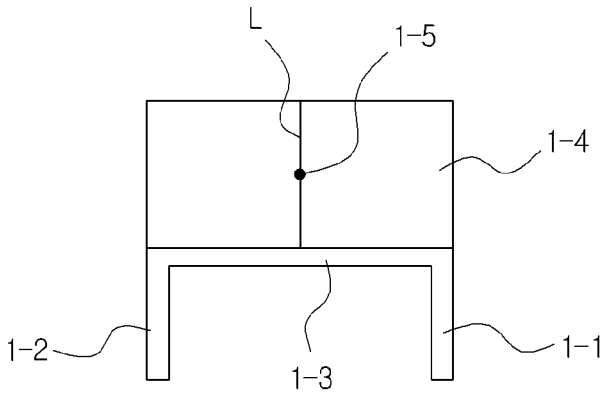
Figure 5:
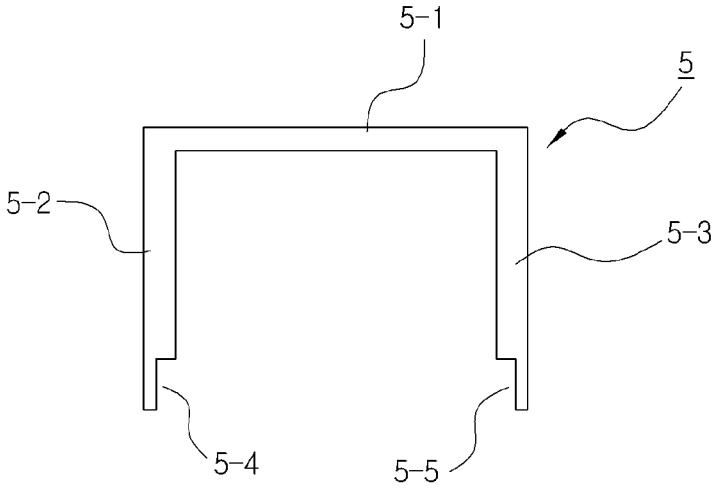
Figure 6:
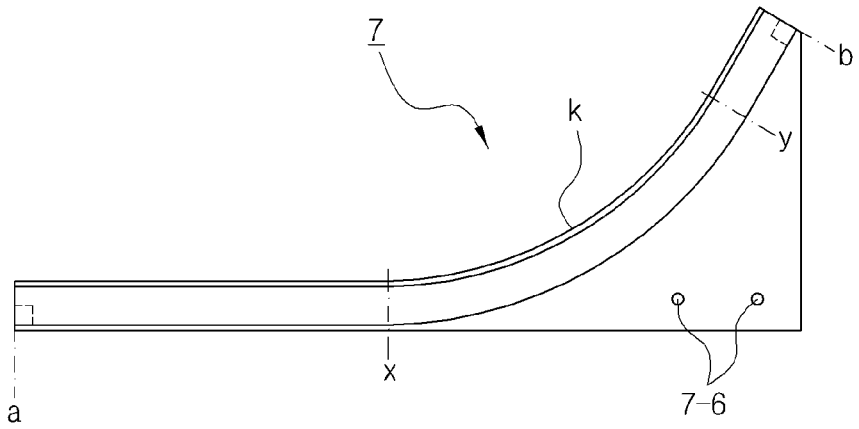
Figure 7A:
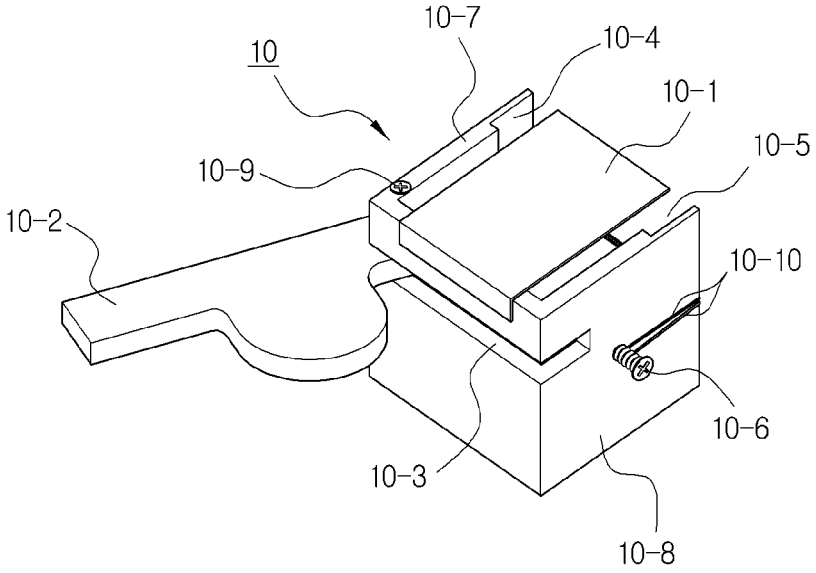
Figure 7B:
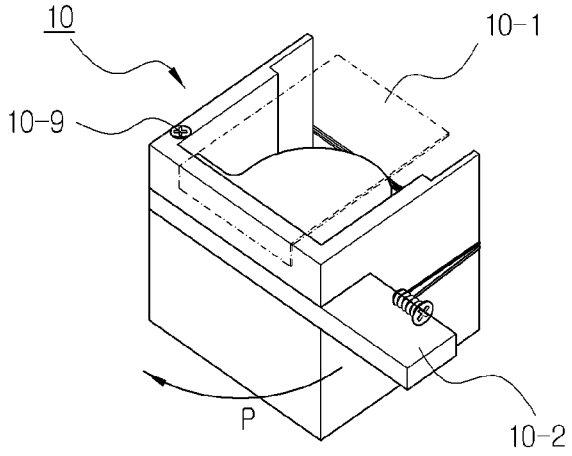

FIG. 4A is an enlarged view of the aiming upper plate 5, a laser direction adjustment plate 1, a laser mount 4, and a laser pointer accommodating portion 3 for accommodating a laser pointer 2 therein;

FIG. 4B is a view of the laser direction adjustment plate 1, viewed from a direction of the laser pointer 2;

FIG. 5 is a sectional view of the aiming upper plate 5 in accordance with the embodiment disclosed herein;

FIG. 6 is a lateral view of a force-conversion roller 7 in accordance with the embodiment disclosed herein; and FIG. 7 is a projected view of a ball height adjustment plate 10 in accordance with the embodiment disclosed herein, in which FIG. 7A illustrates a state that a trigger mechanism 10-2 is drawn out of a trigger mechanism insertion groove 10-3, and FIG. 7B illustrates a state that the trigger mechanism 10-2 is inserted into the trigger mechanism insertion groove 10-3.

DETAILED DESCRIPTION OF THE EXEMPLARY EMBODIMENTS

Certain exemplary embodiments of the present invention will now be described in greater detail with reference to the accompanying drawings. In the following description, the same/like components will have the same/like reference numerals in each drawing and repetitive description thereof will be omitted.

Figure 1:
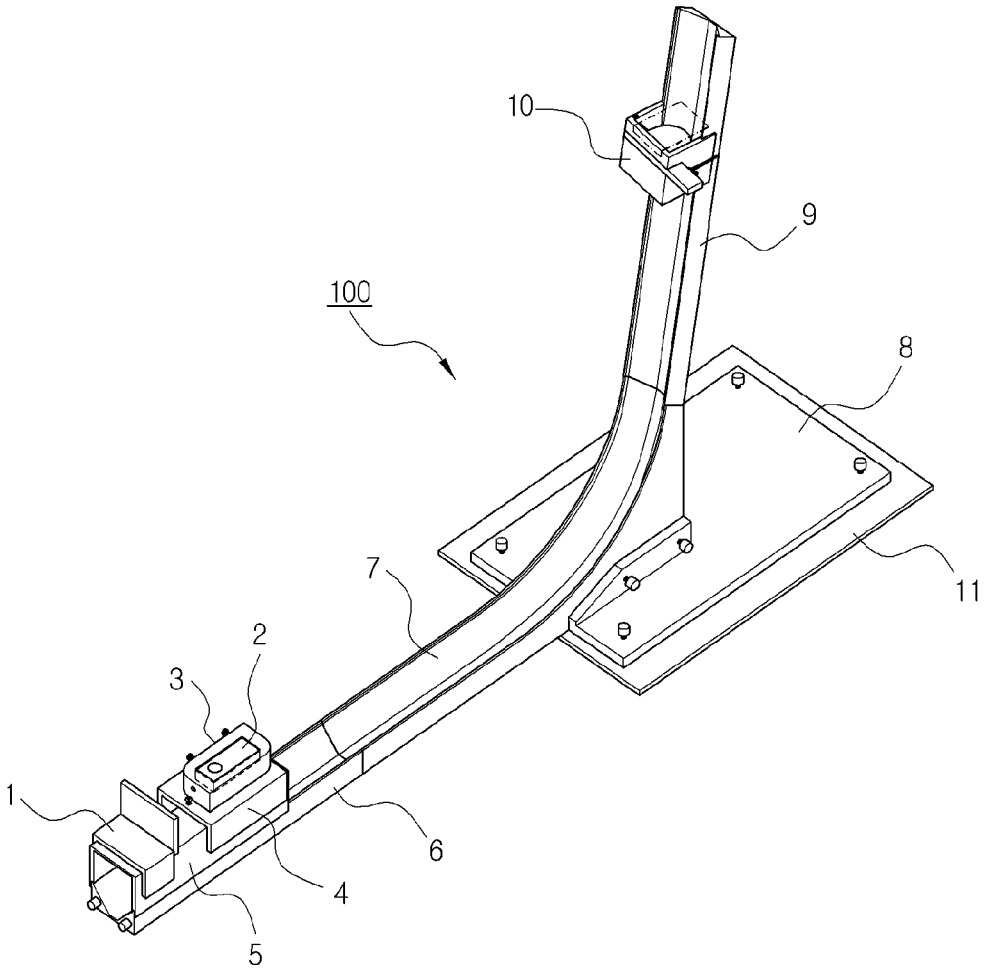
FIG. 1 is a perspective view of a golf putting practice machine 100 having a laser pointer in accordance with an embodiment disclosed herein.
Figure 2:
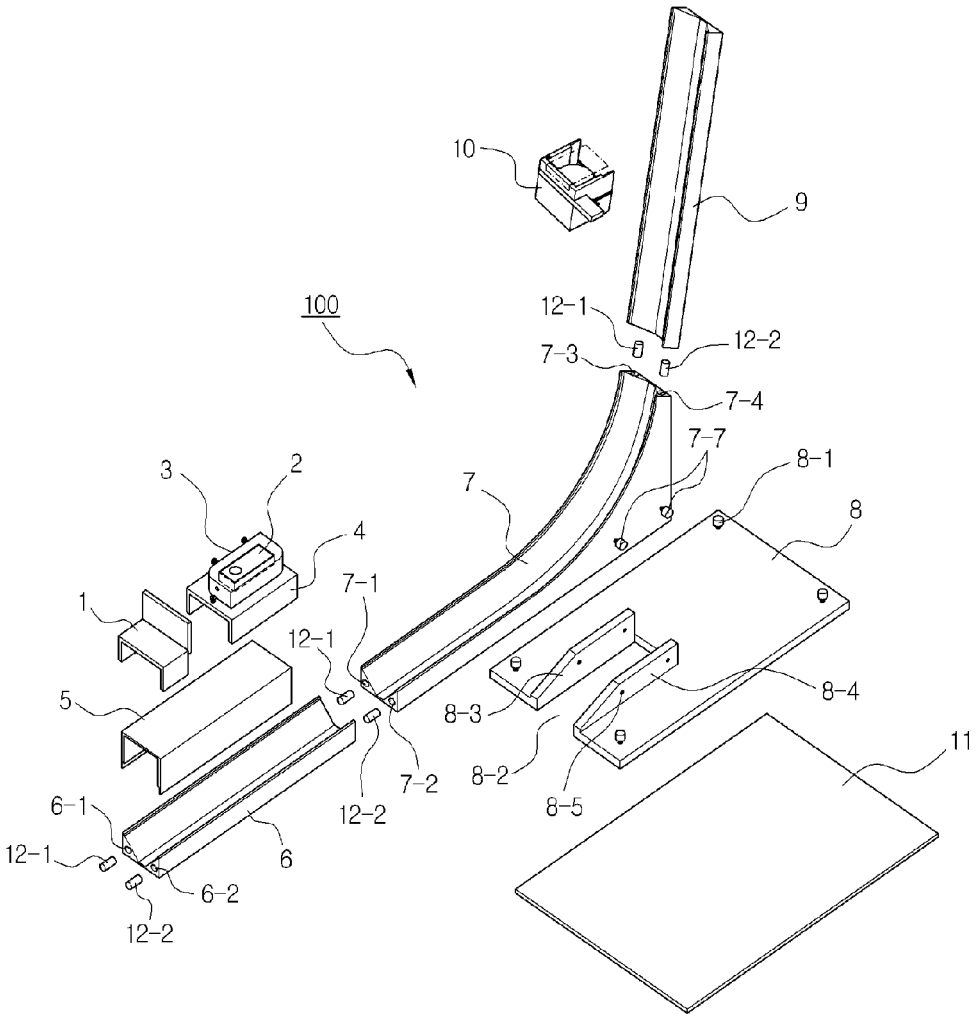
FIG. 2 is an exploded view of the golf putting practice machine 100 having the laser pointer in accordance with the embodiment disclosed herein.
Figure 3:
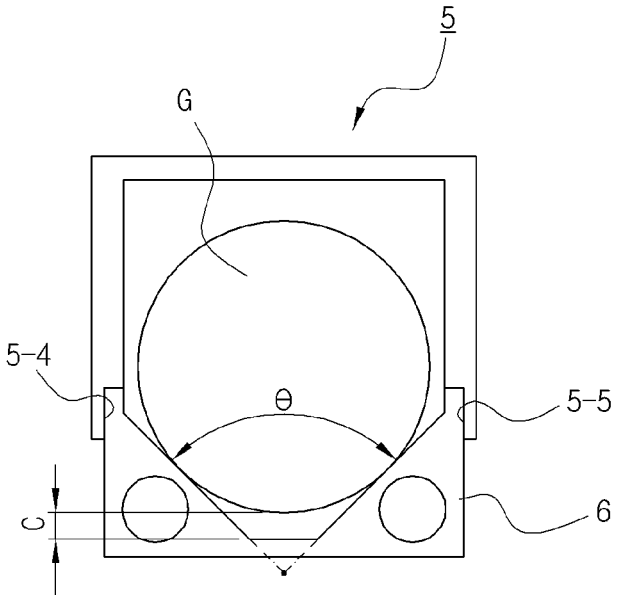
FIG. 3 is a sectional view illustrating an engaged state between an aiming plate 6 and an aiming upper plate 5 in accordance with the embodiment disclosed herein.

FIG. 1 is a perspective view of a golf putting practice machine having a laser pointer in accordance with an embodiment disclosed herein, FIG. 2 is an exploded view of the golf putting practice machine 100 having the laser pointer in accordance with the embodiment disclosed herein, FIG. 3 is a sectional view illustrating an engaged state between an aiming plate 6 and an aiming upper plate 5 in accordance with the embodiment disclosed herein, FIG. 4A is an enlarged view of the aiming upper plate 5, a laser direction adjustment plate 1, a laser mount 4, and a laser pointer accommodating portion 3 for accommodating a laser pointer 2 therein, and FIG. 4B is a view of the laser direction adjustment plate 1, viewed from a direction of the laser pointer 2. FIG. 5 is a sectional view of the aiming upper plate 5 in accordance with the embodiment disclosed herein.

As illustrated in FIG. 1, a golf putting practice machine 100 having a laser pointer according to the present disclosure basically includes a laser direction adjustment plate 1, a laser pointer 2 that emits a laser beam toward the laser direction adjustment plate 1, a laser pointer accommodating portion 3 that accommodates therein the laser pointer 2, a laser mount 4 on which the laser pointer accommodating portion 3 is placed and adhered, an aiming upper plate 5 on which the laser direction adjustment plate 1 and the laser mount 4 are placed to be slidable thereon, an aiming plate 6 that is placed on the aiming upper plate 5 and configured to accurately set a rolling direction of a golf ball, a force-conversion roller 7 that converts a freefall force of the golf ball into a horizontal force, a horizontal adjustment support plate 8 that fixes and supports the force-conversion roller 7 and performs leveling, an inclined height plate 9 that is connected to the force-conversion roller 7 to cause the freefall of the golf ball, and a ball height adjustment plate 10 that is slidably coupled to the inclined height plate 9 to decide a height from which the golf ball freefalls.

Also, a horizontal maintenance plate 11 is provided below the horizontal adjustment support plate 8 so as to facilitate the maintenance of a horizontal level of the golf putting practice machine 100 disclosed herein with respect to the ground.

Hereinafter, description will be given in detail of each component configuring the golf putting practice machine having the laser pointer in accordance with the embodiment disclosed herein.

The laser direction adjustment plate 1 is an element for correctly determining whether or not a laser beam emitted from the laser pointer 2 is directed in a normal direction. The laser direction adjustment plate 1 is placed on the aiming upper plate 5 to be slidable back and forth on the aiming upper plate 5 in a direction indicated with an arrow A illustrated in FIG. 4A, in a manner that inner sides of left and right side surfaces 1-1 and 1-2 of the laser direction adjustment plate 1 are engaged with outer sides of left and right side surfaces 5-2 and 5-3 of the aiming upper plate 5, respectively, and an upper plate 1-3 of the laser direction adjustment plate 1 is brought into contact with a top of the aiming upper plate 5.

The laser direction adjustment plate 1 may be provided with a laser beam aiming plate 1-4 that perpendicularly extends upward from one end portion of the upper plate 1-3 thereof, which faces the laser pointer 2, and a laser beam aligning line L that is formed from up to down along a central portion of the laser beam aiming plate 1-4 and has a central point 1-5. The aligning line L is used for adjusting the direction of the laser beam such that the laser beam can be aligned with the aligning line L by passing through the point 1-5 when the laser beam is emitted.

The laser pointer 2 is an element for emitting the laser beam such that a golfer can correctly confirm an ongoing direction (a proceeding or rolling direction) of a golf ball. When the golfer desires to check the ongoing direction of the golf ball, the emission or prevention of the emission of the laser beam may be controlled by an ON/OFF switch 2-1 which is provided on the laser pointer 2. When the laser pointer 2 is switched on by pressing the ON/OFF switch 2-1, the laser beam is emitted toward the laser beam aiming plate 1-4 of the laser direction adjustment plate 1 through a hole 3-3 formed through the laser pointer accommodating portion 3.

When the laser beam direction adjustment is completed, the laser direction adjustment plate 1 is detached. Here, a direction indicated by the laser beam may be the same as the rolling direction of the golf ball on a flat surface.

The laser pointer accommodating portion 3 is an element for accommodating therein the laser pointer 2. First and second direction adjustment screws 3-1 and 3-2, which adjust the laser beam emitted from the laser pointer 2 to a left or right side, are provided on one side surface of the laser pointer accommodating portion 3. The first and second direction adjustment screws 3-1 and 3-2 are provided on the one side surface of the laser pointer accommodating portion 3 to reach corresponding sides of the laser pointer 2, respectively.

The laser pointer accommodating portion 3 in which the laser pointer 2 is accommodated is firmly fixed at a central portion of the laser mount 4 by a typical method using an adhesive.

The laser mount 4 is an element for allowing the laser pointer accommodated in the laser pointer accommodating portion 3 to be moved to another position. The laser mount 4 is placed on the aiming upper plate 5 to be slidable back and forth on the aiming upper plate 5 in a direction indicated with an arrow B illustrated in FIG. 4, in a manner that inner sides of left and right side surfaces 4-1 and 4-2 of the laser mount 4 are engaged with outer sides of left and right side surfaces 5-1 and 5-2 of the aiming upper plate 5 and an upper plate 4-3 of the laser mount 4 is brought into contact with the top of the aiming upper plate 5.

The upper plate 4-3 of the laser mount 4 is provided with a height adjustment screw 4-4 that is located at a central portion thereof, which is spaced apart from an end portion thereof, which faces the laser direction adjustment plate 1, by a predetermined distance toward the laser pointer accommodating portion 3, so as to adjust the height of the laser mount 4 in up and down directions. Thus, when the height adjustment screw 4-4 rotates to left and right, the height adjustment screw 4-4 is brought into contact with the top of the aiming upper plate 5. Accordingly, the height of the laser mount 4 may be adjustable up and down according to the extent of rotation of the height adjustment screw 4-4. This may result in a vertical adjustment of the height of the laser beam emitted from the laser pointer 2.

This corresponds to performing a height-adjustment function when it is impossible to measure the height of the laser beam due to being too high or too low.

Prior to using the golf putting practice machine having the laser pointer according to the present disclosure, the laser direction adjustment plate 1 and the laser mount 4 are slidably moved back and forth along the directions of the arrows A and B, respectively, to decrease an interval between the laser direction adjustment plate 1 and the laser mount 4. Under this state, the laser beam is emitted to the laser direction adjustment plate 4 so as to check whether or not the laser beam is correctly aligned with the central point 1-5 of the aligning line L of the laser beam aiming plate 1-4.

When the laser beam is correctly aligned with the central point 1-5 of the aligning line L, the laser direction adjustment plate 1 and the laser mount 4 are slid along the directions of the arrows A and B, respectively, so as to be spaced more apart from each other. Under this state, the laser beam is emitted to the laser direction adjustment plate 1, to check again whether or not the laser beam is correctly aligned with the central point 1-5 of the aligning line L of the laser beam aiming plate 1-4. When it is checked again that the laser beam is correctly aligned with the central point 1-5 of the aligning line L, the laser beam emitted from the laser pointer 2 is determined to be directed in the correct direction.

Meanwhile, in the more spaced state between the laser direction adjustment plate 1 and the laser mount 4, when the laser beam is not correctly aligned with the central point 1-5 of the aligning line L, the following adjustment process is performed to correctly align the laser beam with the central point 1-5 of the aligning line L.

That is, when the laser beam emitted from the laser pointer 2 is emitted to a right side of the aligning line L of the laser beam aiming plate 1-4 in a state of being viewed from the side of the laser pointer 2, the first direction adjustment screw 3-1 is rotated to push a front end portion of the laser pointer 2. Accordingly, the laser beam emitted from the laser pointer 2 is moved to a left side so as to be aligned with the central point 1-5 of the aligning line L of the laser beam aiming plate 1-4. Also, when the laser beam emitted from the laser pointer 2 is emitted to a left side of the aligning line L of the laser beam aiming plate 1-4, the second direction adjustment screw 3-2 is rotated to push a rear end portion of the laser pointer 2. Accordingly, the laser beam emitted from the laser pointer 2 is moved to a right side so as to be aligned with the central point 1-5 of the aligning line L of the laser beam aiming plate 1-4.

That is, the first and second direction adjustment screws 3-1 and 3-2 may allow the arrival position of the laser beam which is emitted from the laser pointer 2 to be adjustable to the left or right side with respect to the laser beam aiming plate 1-4 of the laser direction adjustment plate 1. This may result in the alignment of the laser beam by an accurate zero-point adjustment with respect to a position tp which a golf ball is to go, prior to the use of the golf putting practice machine having the laser pointer disclosed herein.

The vertical adjustment of the laser beam, as aforementioned, is realized by the height adjustment screw 4-4 provided on the laser mount 4.

The aiming upper plate 5 is an element which moves back and forth while the laser direction adjustment plate 1 and the laser mount 4 are placed thereon, so as to decide an emission position of the laser beam emitted from the laser pointer 2. The laser direction adjustment plate 1 and the laser pointer accommodating portion 3 are slidably mounted on the aiming upper plate 5, and a section of the aiming upper plate 5 is illustrated in FIG. 5.

That is, the aiming upper plate 5 is provided with an upper surface 5-1, and left and right side surfaces 5-2 and 5-3 perpendicularly extending downward from both end portions of the upper plate 5-1, respectively. Also, cutoff portions 5-4 and 5-5 are formed by partially cutting off lower ends of the left and right side surfaces 5-2 and 5-3, respectively, in a lengthwise direction.

The aiming upper plate 5 is slidable on the aiming plate 6 in a manner that the cutoff portions 5-4 and 5-5 are engaged with both outer sides of an upper surface of the aiming plate 6. Also, the aiming upper plate 5 may also be slidably engaged with the force-conversion roller 7 as well as the aiming plate 6, if required.

Inner surfaces of the cutoff portions 5-4 and 5-5 which are engaged with the aiming plate 6 of the aiming upper plate 5 are processed through a high glossy process to facilitate for sliding of the aiming upper plate 5.

The aiming plate 6 is an element for setting an accurate direction that the golf ball rolls, and is provided at the front end of the force-conversion roller 7. A pair of insertion holes 6-1 and 6-2, in which a pair of insertion members 12-1 and 12-2 formed in a cylindrical shape is inserted, is formed at one end of the aiming plate 6 along which the golf ball rolls out. A pair of insertion holes (not illustrated) in which the pair of insertion members 12-1 and 12-2 is inserted is also formed at the other end of the aiming plate 6 coupled with the force-conversion roller 7.

That is, the aiming plate 6 is connected to the force-conversion roller 7 in a manner that the insertion members 12-1 and 12-2 are inserted into the insertion holes formed at the other end thereof coupled with the force-conversion roller 7 and the inserted insertion members 12-1 and 12-2 are inserted into a pair of insertion holes 7-1 and 7-2 formed at the force-conversion roller 7.

In a state where the pair of insertion members 12-1 and 12-2 is inserted into the pair of insertion holes 6-1 and 6-2 of the aiming plate 6 formed at one end of the aiming plate 6 along which the golf ball rolls out, the inserted insertion members 12-1 and 12-2 are inserted into insertion holes of another aiming plate which is the same as the aiming plate 6, thereby connecting two aiming plates for use.

The aiming plate 6, as illustrated in FIG. 3, has a sectional shape of ⩘, and defines a rolling path along which the golf ball G is directed in an accurate direction. The aiming plate 6 is fabricated by precisely machining an acryl rod through a typical mock-up process.

The aiming plate 6 is placed horizontal to a bottom surface of a putting green of a golf course (for example, a bottom surface with grass of the golf course), such that the golf ball G can accurately rolls in an ongoing direction along the ⩘-shaped rolling path of the aiming plate 6. That is, the aiming plate 6 serves as a gunbarrel of a rifle, such that the golf ball can roll up accurately without an error toward a target position along an aiming direction so as to arrive at the position.

Further, as can be noticed in FIG. 3, a golf ball G rolls forward in a state where a lower end of the golf ball is spaced apart from a bottom of the aiming plate 6 by a length (c), and outer contact portions of the golf ball come in contact with outer contact portions of inclined surfaces of an inner surface of the aiming plate 6. Hence, a distance (c) between the lower end of the golf ball and the bottom of the aiming plate 6 may be remarkably reduced rather than the conventional device (for example, U.S. Pat. No. 1,146,396), which can ensure smooth rolling of the golf ball with rarely causing a height difference when the golf ball comes in contact with the ground after rolling out of the aiming plate 6.

An angle θ formed by the both outer contact portions of the inner inclined surfaces of the aiming plate 6 is 90°, but the angle θ may range from 1° to 179°, if required.

The force-conversion roller 7 is an element which performs a function of converting the freefall of the golf ball into a horizontal force, and is a component playing a core role of the present disclosure.

FIG. 6 is a lateral view of the force-conversion roller 7 in accordance with the embodiment disclosed herein.

One end (a) of the force-conversion roller 7 along which the golf ball rolls out is connected with the aiming plate 6 by the aforementioned method, and the other end (b) thereof is connected with the height inclined plate 9 by the same method as connecting the aiming plate 6.

That is, the force-conversion roller 7 is connected to the inclined height plate 9 in a manner that the insertion members 12-1 and 12-2 are inserted into a pair of insertion holes 7-3 and 7-4 formed at the other end (b) thereof, which is connected to the inclined height plate 9, and the inserted insertion members 12-1 and 12-2 are inserted into a pair of insertion holes formed at one end of the inclined height plate 9.

The force-conversion roller 7, the aiming plate 6 and the inclined height plate 9 have the same sectional shape of ⩘, as illustrated in FIG. 3.

Referring to FIG. 6, to convert the freefall of the golf ball into the horizontal force, the force-conversion roller 7 has an arcuate portion (K) formed in an arcuate shape from a first part (x) to a second part (y). The arcuate portion (K) is formed in the arcuate shape with a radius of 200 mm. That is, an angle formed between a portion from the first part (x) to the one end (a) and a portion from the second part (y) to the other end (b) is 60°. However, the angle of the arcuate shape of the arcuate portion (K) may range from 1° to 90° according to the characteristic of a required function.

The arcuate portion (K) is arcuate with the radius of 200 mm for the arcuate shape and for convenience, but the radius may be in the range of 50 mm to 1,000 mm.

Meanwhile, a length from the first part (x) to the one end (a) of the force-conversion roller 7 is 200 mm, and a length from the second part (y) to the other end (b) is 50 mm. However, the length from the first part (x) to the one end (a) may not be set, or be set to 100 mm or up to 1,000 mm, if required.

Also, the length from the first part (x) to the one end (a) and the length from the second part (y) to the other end (b) of the force-conversion roller 7 are set to 200 mm and 50 mm, respectively, but such lengths may change within the range of 0 mm to 1,000 mm, if necessary.

In addition, totally four fastening screw holes 7-6 are provided by two at each of both sides of a lower end portion of the force-conversion roller 7, such that the force-conversion roller 7 can be connected to the horizontal adjustment support plate 8.

The horizontal adjustment support plate 8 is an element for fixing and supporting the force-conversion roller 7 such that the golf putting practice machine 100 can operate in a stable state when rolling the golf ball.

In addition, without a horizontal adjustment, accuracies of distance and direction that the golf ball rolls cannot be ensured. Therefore, the horizontal adjustment support plate 8 also performs a horizontal adjustment function in a state of stably fixing and supporting the force-conversion roller 7.

Horizontal adjustment screws 8-1 are provided on four corner portions of the horizontal adjustment support plate 8. Hence, the four horizontal adjustment screws 8-1 are adjusted to adjust heights of four portions of the horizontal adjustment support plate 8. This may allow the golf putting practice machine 100 to be horizontal to the ground.

Also, a cutoff portion 8-2 is formed by cutting off one end portion of the horizontal adjustment support plate 8 into a shape of "ㄷ." A pair of connection supporting portions 8-3 and 8-4 perpendicularly extends upward from both sides of the cutoff portion 8-2. Four through holes 8-5 are formed through the pair of connection supporting portions 8-3 and 8-4 to correspond to the respective four fastening screw holes 7-6, which are formed at the lower end portion of the force-conversion roller 7.

Therefore, the force-conversion roller 7 and the horizontal adjustment support plate 8 can be firmly coupled to each other in a manner that four fastening screws 7-7 are screwed into the four fastening screw holes 7-6 of the force-conversion roller 7 through the four through holes 8-5 of the horizontal adjustment support plate 8.

For example, if the ground, like the grass, is not hard, the horizontal maintenance plate 11 is installed below the horizontal adjustment support plate 8 to replace a hard ground, thereby facilitating the horizontal adjustment in response to the height adjustment of the four horizontal adjustment screws 8-1.

The inclined height plate 9 has the same shape as the aiming plate 6, and is coupled to the force-conversion roller 7 according to the same method as the method in which the aiming plate 6 is coupled to the force-conversion roller 7, so as to decide a height from which the golf ball freefalls and also serve as a freefall path.

Two or three of the inclined height plate 9 may be connected to increase the height from which the golf ball freefalls. However, according to an experimental result, actually, the connection more than three of the inclined height plates 9 is rarely used.

FIG. 7 is a protected view of a ball height adjustment plate 10 in accordance with the embodiment disclosed herein, in which FIG. 7A illustrates a state that a trigger mechanism 10-2 is drawn out of a trigger mechanism insertion groove 10-3, and FIG. 7B illustrates a state that the trigger mechanism 10-2 is inserted into the trigger mechanism insertion groove 10-3.

The ball height adjustment plate 10 is configured for the golf ball to freefall without any force applied while the golf ball is placed thereon. For example, triggering is instantaneously done, like a rifle of a gun.

The ball height adjustment plate 10 is provided with cutoff portions 10-4 and 10-5 which are formed by partially cutting off ends of both side surfaces 10-7 and 10-8 thereof in a vertical direction, respectively. The ball height adjustment plate 10 is slidable up and down on the inclined height plate 9 in a manner that the cutoff portions 10-4 and 10-5 are engaged with both sides of an upper end of the inclined height plate 9 (for example, as illustrated in FIG. 3, being engaged according to the way that the aiming plate 6 is engaged with the aiming upper plate 5).

A trigger mechanism 10-2 which is rotatable centering on a shaft 10-9 is provided at the ball height adjustment plate 10. The trigger mechanism 10-2, as illustrated in FIG. 7B, is inserted into a trigger mechanism insertion groove 10-3, which is formed at a front surface of the ball height adjustment plate 10, in response to the rotation centering on the shaft 10-9.

As illustrated in FIG. 7A, a golf ball holder 10-1 on which the golf ball is directly placed is attached onto an upper plate of a front surface of the ball height adjustment plate 10. A portion of the golf ball holder 10-1, except for the portion attached to the upper plate of the front surface of the ball height adjustment plate 10, is orthogonally folded so as to come in contact with an upper portion of the trigger mechanism 10-2.

In a state illustrated in FIG. 7B, when the golf ball is placed on the golf ball holder 10-1, upon rotating the trigger mechanism 10-2 in a direction of an arrow P centering on the shaft 10-9, the golf ball instantaneously rolls down from the holder 10-1 to freefall as soon as the trigger mechanism 10-2 is drawn out of the trigger mechanism insertion groove 10-3. That is, the golf ball is allowed for an instantaneous freefall without a contact with an upper surface of the trigger mechanism 10-2. This may prevent the golf ball from coming in contact with the upper surface of the trigger mechanism 10-2.

That is, golf ball drifting, which is caused due to a friction between the golf ball and the upper surface of the trigger mechanism 10-2 when the golf ball and the upper surface of the trigger mechanism 10-2 come in contact with each other, can be avoided. Therefore, the golf ball can freefall at an accurate position without the golf ball drifting due to the friction against the upper surface of the trigger mechanism 10-2.

The golf ball holder 10-1 may be made of any material if it is pressed down by the weight of the golf ball immediately when the trigger mechanism 10-2 is drawn out of the trigger mechanism insertion groove 10-3, such that the golf ball can freefall.

Elastic member fixing pins 10-6 are disposed at central portions of the both side surfaces 10-7 and 10-8 of the ball height adjustment plate 10, respectively. Elastic members 10-10 are fixed at the corresponding elastic member fixing pins 10-6. As aforementioned, each of the elastic members 10-10 is installed to surround the inclined height plate 9 to apply an elastic force thereto while the height adjustment plate 10 is slidably mounted on the inclined height plate 9. Such elastic forces of the elastic members 10-10 may allow the ball height adjustment plate 10 to be firmly adhered onto a predetermined position of the inclined height plate 9.

Hereinafter, an operating principle of the golf putting practice machine 100 having the configuration disclosed herein will be described.

First, description will be given in view of speed.

Putting speed ultimately relates to a force control. That is, an ongoing distance of a golf ball increases when the ball is hit strongly, while decreasing when the ball is hit softly.

It is difficult to quantify a force of hitting a ball upon the putting, but every golfer hits balls with calculating the hitting force according to their own ways. However, if the golf putting practice machine disclosed herein is used, the force of hitting the ball can be accurately calculated into a numeral value.

For example, at the same position, when a golf ball is dropped from a high height, the golf ball goes farther than when being dropped from a low height. Also, when the height increases by two times, the force increases by two times and speed by four times. However, an ongoing distance of the golf ball does not increase exactly by four times due to a state of a lie.

When putting is done by a force of 50, if about 10% of force is insufficient, a force of 55 can be applied to putt a ball, but golfers are unable to accurately adjust it. However, upon putting using the golf putting practice machine 100 disclosed herein, the ball can be hit by adjusting the putting force exactly to the force of 55.

For example, upon the lack of 10 cm for 3 m putting, if the golf putting practice machine 100 disclosed herein is used, putting speed may be calculated based on a height corresponding to a value which is calculated and indicated by the ball height adjustment plate 10, such that the ball can go 10 cm or 20 cm more exactly in the corresponding direction.

Hereinafter, description will be given in view of an ongoing direction.

The use of the golf putting practice machine 100 disclosed herein may enable setting of an accurate ongoing direction of a golf ball G. For example, when the ball has to go 10 cm right of a hole cup, the golf putting practice machine disclosed herein should be located to face the corresponding direction. Here, to find an accurate direction, the laser pointer 2 is used.

For example, if a position of 20 cm right of a hole cup has to be set upon 20*m* putting, the golf putting practice machine 100 is directed to face the corresponding position by emitting a laser beam by the laser pointer 2 to the position of 20 cm right of the hole cup, and then the ball rolls using the golf putting practice machine 100. Here, if the ball goes right of the hole cup without going in the hole cup, the position is set to about 18 cm right of the hole cup. Therefore, the laser pointer 2 is reset to emit the laser beam toward the corresponding position, thereby recognizing an accurate direction.

That is, the use of the golf putting practice machine 100 disclosed herein may enable the recognition as to at which lie and in which direction putting has to be done to obtain higher probability, or allow the ball to come out with turning around the hole cup.

Hereinafter, description will be given of a method of using the golf putting practice machine 100 according to the present disclosure.

If the golf putting practice machine 100 is used, golfers (or cadies) may be trained (educated), which will be explained.

A golfer should be able to exactly read lies (meanwhile, an important role of a caddy is to accurately read a putting lie and inform the read lie to a golfer). There may be many directions in a golf course depending on speed upon putting. However, if it is assumed that an accurate speed is as fast as passing a hole cup over about 1 m, speed and direction are considered as being set, and the golfer (or the caddy) should accurately recognize these.

For example, if 10 golfers (or 10 caddies) are asked for writing ongoing direction and speed of golf balls when the balls are placed on a green just like in an actual game, the 10 golfers (or 10 caddies) may distinguishably represent a speed in proportion to a specific height of the inclined height plate 9 of the golf putting practice machine 100 and a position of the laser pointer 2, for example, direction and height, such as 7.5 cm right of a hole cup, a height of 35 cm and the like. Testing using the golf putting practice machine 100 disclosed herein, a golfer who writes the accurate speed and the position of the laser pointer 2 has been found.

Meanwhile, upon using the golf putting practice machine 100, when a ball is hit at the same speed in the morning and in the afternoon that grass has grown, a distance difference according to a length of the grass can be correctly measured. That is, even though a ball rolls at the same position at the same speed in the same direction, the distance difference between the morning and the afternoon can be measured with an error below 0.1%.

Hereinafter, description will be given of a method of practicing putting using the golf putting practice machine 100 disclosed herein.

When putting is practiced in the green, if it is difficult for a golfer to determine whether or not he or she is practicing at a correct speed and in a correct direction, a point where a ball is placed is set and the laser pointer 2 emits the laser beam toward a desired point to set a direction. Under this state, when the ball rolls, an arrival point of the ball provides correct direction and speed. When the golfer putts a ball toward a desired point at a speed expected by the golfer himself or herself and the ball arrives at the arrival point of the previous ball, it is considered as the golfer being putting the ball in a correct manner.

Meanwhile, prior to practicing putting using the golf putting practice machine 100 disclosed herein, the golfer should set a height (speed) of the putting practice machine 100 and his or her putting speed.

The present invention is not limited by those preferred embodiments, and those skilled in the art will appreciate that various modifications, additions and substitutions are possible, without departing from essential characteristics of the disclosure.

What is claimed is:

1. A golf putting practice machine having a laser pointer, the machine comprising:

a laser direction adjustment plate (1) that is configured to determine whether or not an emitted laser beam is directed in a normal direction;

a laser pointer (2) that is configured to emit the laser beam toward the laser direction adjustment plate (1) when an ON/OFF switch (2-1) is in the ON state, wherein the switch is arranged to enable or prevent the emission of the laser beam;

a laser pointer accommodating portion (3) that is configured to accommodate and fix the laser pointer (2) therein;

a laser mount (4) on which the laser pointer accommodating portion (3) is mounted in an adhering manner;

an aiming upper plate (5) on which the laser direction adjustment plate (1) and the laser mount (4) are placed so as to be slidable;

an aiming plate (6) on which the aiming upper plate (5) is placed such that the ongoing direction of a golf ball is accurately set;

a force-conversion roller (7) that is configured to convert the freefall of a golf ball into a horizontal force;

a horizontal adjustment support plate (8) that is configured to fix and support the force-conversion roller (7) and perform leveling;

an inclined height plate (9) that is connected to the force-conversion roller (7) so as to cause the golf ball to freefall; and;

a ball height adjustment plate (10) that is slidably connected to the inclined height plate (9) so as to determine the height from which the golf ball freefalls.

2. The practice machine of claim 1, further comprising a horizontal maintenance plate (11) that is provided below the horizontal adjustment support plate (8) such that the horizontal adjustment (8) support plate is kept horizontal to the ground.

3. The practice machine of claim 1, wherein the laser direction adjustment plate (1) is placed on the aiming upper plate (5) to be slidable on the aiming upper plate (5) in a manner that inner sides of left and right side surfaces (1-1, 1-2) thereof are engaged with outer sides of left and right side surfaces (5-2, 5-3) of the aiming upper plate (5), respectively, and an upper plate (1-3) thereof is brought into contact with a top of the aiming upper plate (5).

4. The practice machine of claim 1, wherein the laser direction adjustment plate (1) is provided with a laser beam aiming plate (1-4) that perpendicularly extends upward from one end portion of an upper plate (1-3) thereof, the one end portion facing the laser pointer (2), and a laser beam aligning line (L) that is formed from up to down along a central portion of the laser beam aiming plate (1-4) and has a central point (1-5).

5. The practice machine of claim 1, wherein the laser pointer accommodating portion (3) comprises:

first and second direction adjustment screws (3-1, 3-2) that are provided on one side surface thereof to adjust a laser beam emitted from the laser pointer (2) to a left or right side; and a hole (3-3) through which the laser beam emitted from the laser pointer (2) passes, wherein the first and second direction adjustment screws (3-1, 3-2) are disposed at the one side surface of the laser pointer accommodating portion (3) to reach corresponding one side portions of the laser pointer (2), respectively.

6. The practice machine of claim 1, wherein the laser beam emitted from the laser pointer (2) is emitted toward a laser beam aiming plate (1-4) of the laser direction adjustment plate (1) through a hole (3-3) formed through the laser pointer accommodating portion (3).

7. The practice machine of claim 1, wherein the laser mount (4) is placed on the aiming upper plate (5) to be slidable back and forth on the aiming upper plate (5) in a manner that inner sides of left and right side surfaces (4-1, 4-2) thereof are engaged with outer sides of left and right side surfaces (5-2, 5-3) of the aiming upper plate (5), respectively, and an upper plate (4-3) thereof is brought into contact with a top of the aiming upper plate (5).

8. The practice machine of claim 1, wherein an upper plate (4-3) of the laser mount (4) is provided with a height adjustment screw (4-4) that is located at a central portion thereof, so as to adjust the height of the laser mount (4) in up and down directions, wherein the central portion is spaced apart from an end portion of the upper plate (4-3), which faces the laser direction adjustment plate (1), by a predetermined distance toward the laser pointer accommodating portion (3).

9. The practice machine of claim 1, wherein the aiming upper plate (5) is engaged with the aiming plate (6) to be slidable on the aiming plate (6), wherein the aiming upper plate (5) comprises an upper surface (5-1), and left and right side surfaces (5-2, 5-3) that perpendicularly extend downward from both end portions of the upper surface (5-1), wherein cutoff portions (5-4, 5-5) are formed by partially cutting off lower end portions of the left and right side surfaces (5-2, 5-3) in a lengthwise direction, respectively, and wherein the aiming upper plate (5) is slidable on the aiming plate (6) in a manner that the cutoff portions (5-4, 5-4) are engaged with both outer sides of a top of the aiming plate (6).

10. The practice machine of claim 9, wherein the aiming upper plate (5) is engaged with the force-conversion roller (7) to be slidable thereon.

11. The practice machine of claim 1, wherein the aiming plate (6) is coupled to a front end of the force-conversion roller (7), and wherein the aiming plate (6) comprises:

a pair of insertion holes (6-1, 6-2) that is formed at one end along which the golf ball rolls out, and in which a pair of insertion members (12-1, 12-2) formed in a cylindrical shape is inserted; and a pair of insertion holes that is formed at the other end thereof coupled with the force-conversion roller (7) and in which the pair of insertion members (12-1, 12-2) is inserted.

12. The practice machine of claim 11, wherein the aiming plate (6) is coupled to the force-conversion roller (7) in a manner that the insertion members (12-1, 12-2) are inserted into the pair of insertion holes, which is formed at the other end of the aiming plate (6) coupled with the force-conversion roller (7), and the inserted insertion members (12-1, 12-2) are inserted into a pair of insertion holes (7-1, 7-2) formed at the force-conversion roller (7).

13. The practice machine of claim 11, wherein two of the aiming plates are coupled to each other for use in a manner that the pair of insertion members (12-1, 12-2) are inserted into the pair of insertion holes (6-1, 6-2) of the aiming plate (6), which is formed at the one end along which the golf ball rolls out, and the inserted insertion members (12-1, 12-2) are then inserted into insertion holes of another aiming plate, which is the same as the aiming plate (6).

14. The practice machine of claim 11, wherein the golf ball rolls forward in a state where a lower end of the golf ball is spaced apart from a bottom of the aiming plate (6) by a length (c), and outer contact portions of the golf ball come in contact with outer contact portions of inclined surfaces of an inner surface of the aiming plate (6).

15. The practice machine of claim 1, wherein the force-conversion roller (7) has one end (a), along which the gold ball rolls out and to which the aiming plate (6) is connected, and the other end (b) to which the inclined height plate (9) is connected, wherein the force-conversion roller (7) and the inclined height plate (9) are connected to each other in a manner that insertion members (12-1, 12-2) are inserted into a pair of insertion holes (7-3, 7-4) formed at the other end (b) coupled with the inclined height plate (9), and the inserted insertion members (12-1, 12-2) are then inserted into a pair of insertion holes formed at one end of the inclined height plate (9), and wherein totally four fastening screw holes (7-6) are provided by two at each of both sides of a lower end portion of the force-conversion roller (7), such that the force-conversion roller can be connected to the horizontal adjustment support plate (8).

16. The practice machine of claim 15, wherein the force-conversion roller (7) has an arcuate portion (K) formed in an arcuate shape from a first part (x) to a second part (y), wherein the arcuate portion (K) is formed in the arcuate shape with a radius of 200 mm, such that an angle formed between a portion from the first part (x) to the one end (a) and a portion from the second part (y) to the other end (b) is 60°.

17. The practice machine of claim 16, wherein an angle of the arcuate shape of the arcuate portion (K) ranges from 1° to 90°.

18. The practice machine of claim 16, wherein the arcuate portion (K) is formed in the arcuate shape with a radius of 50 mm to 1,000 mm.

19. The practice machine of claim 15, wherein a length from the first part (x) to the one end (a) of the force-conversion roller (7) is 200 mm, and a length from the second part (y) to the other end (b) is 50 mm.

20. The practice machine of claim 15, wherein the length from the first part (x) to the one end (a) of the force-conversion roller (7) ranges from 0 mm to 1,000 mm.

21. The practice machine of claim 15, wherein the length from the second part (y) to the other end (b) of the force-conversion roller (7) ranges from 0 mm to 1,000 mm.

22. The practice machine of claim 1, wherein the horizontal adjustment support plate (8) comprises:

an horizontal adjustment screws (8-1) that are provided at four corner portions, respectively;

a cutoff portion (8-2) formed at one end thereof by being cut off into a shape of "ㄷ"; and a pair of connection supporting portions (8-3, 8-4) that perpendicularly extends upward from both sides of the cutoff portion (8-2), respectively, wherein the horizontal adjustment support plate is set to be horizontal with respect to the ground in a manner of adjusting heights of four portions thereof by adjusting the four horizontal adjustment screws (8-1), respectively, wherein the pair of connection supporting portions (8-3, 8-4) is provided with four through holes (8-5) corresponding to four fastening screw holes (7-6), which are formed at a lower end portion of the force-conversion roller (7), and wherein the force-conversion roller (7) and the horizontal adjustment support plate (8) are coupled to each other in a manner that four fastening screws (7-7) are screwed into the four fastening screw holes (7-6) of the force-conversion roller (7) through the four through holes (8-5) of the horizontal adjustment support plate (8).

23. The practice machine of claim 1, wherein two or three of the inclined height plates (9) are connected for use.

24. The practice machine of claim 1, wherein the ball height adjustment plate (10) comprises:

both side surfaces (10-7, 10-8) that have cutoff portions (10-4, 10-5) formed by partially cutting off ends of the both side surfaces in a vertical direction, respectively;

a trigger mechanism (10-2) that is rotatable centering on a shaft (10-9);

a golf ball holder (10-1) that has a top of a front surface with the golf ball placed thereon, and one end attached onto an upper plate of a front surface of the height adjustment plate (10), wherein the other portion of the golf ball holder (10-1) except for the one end is orthogonally folded to be brought into contact with an upper portion of the trigger mechanism (10-2);

elastic member fixing pins (10-6) that are located on central portions of the both side surfaces (10-7, 10-8), respectively; and elastic members (10-10) that are fixed at the elastic member fixing pins (10-6), respectively, wherein the cutoff portions (10-4, 10-5) are engaged with both sides of the upper end of the inclined height plate (9) such that the ball height adjustment plate (10) can be slidable up and down along the inclined height plate (9), and wherein the trigger mechanism (10-2) is inserted into a trigger mechanism insertion groove (10-3), which is formed at the front surface of the ball height adjustment plate (10) in a manner of rotating centering on the shaft (10-9).

25. The practice machine of claim 24, wherein the golf ball holder (10-1) is made of a material, which is pressed down by the weight of the golf ball immediately when the trigger mechanism (10-2) is drawn out of the trigger mechanism insertion groove (10-3), such that the golf ball can immediately freefall.

26. The practice machine of claim 1, wherein the force-conversion roller (7), the aiming plate (6) and the inclined height plate (9) have a sectional shape of 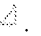 .

27. The practice machine of claim 26, wherein an angle (θ) formed by both outer contact portions of inclined surfaces of an inner surface of the shape of 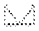 is 90°.

28. The practice machine of claim 26, wherein an angle (θ) formed by both outer contact portions of inclined surfaces of an inner surface of the shape of 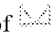 is in the range of 1° to 179°.

* * * * *